US009172195B2

(12) United States Patent
Chen et al.

(10) Patent No.: US 9,172,195 B2
(45) Date of Patent: Oct. 27, 2015

(54) COAXIAL CABLE END CONNECTOR

(71) Applicant: SPEED TECH CORP., Taoyuan Hsien (TW)

(72) Inventors: Li-Sen Chen, Taoyuan Hsien (TW); Yen-Jang Liao, Taoyuan Hsien (TW); Ken Hsieh, Taoyuan Hsien (TW)

(73) Assignee: SPEED TECH CORP., Taoyuan (TW)

( * ) Notice: Subject to any disclaimer, the term of this patent is extended or adjusted under 35 U.S.C. 154(b) by 13 days.

(21) Appl. No.: 14/157,533

(22) Filed: Jan. 17, 2014

(65) Prior Publication Data

US 2014/0206229 A1 Jul. 24, 2014

(30) Foreign Application Priority Data

Jan. 18, 2013 (TW) ..... 102201269 U

(51) Int. Cl.
*H01R 24/38* (2011.01)

(52) U.S. Cl.
CPC ..... *H01R 24/38* (2013.01)

(58) Field of Classification Search
CPC ... H01R 2103/00; H01R 9/0518; H01R 24/40
See application file for complete search history.

(56) References Cited

U.S. PATENT DOCUMENTS

| | | | | |
|---|---|---|---|---|
| 6,508,668 | B1 | 1/2003 | Yamane | |
| 7,118,404 | B2 * | 10/2006 | Ploesser | 439/398 |
| 7,938,681 | B2 * | 5/2011 | Lee et al. | 439/582 |
| 8,172,613 | B1 * | 5/2012 | Chen et al. | 439/582 |
| 8,272,894 | B2 * | 9/2012 | Chiu | 439/582 |
| 2002/0155755 | A1 * | 10/2002 | Yamane | 439/582 |
| 2003/0181100 | A1 * | 9/2003 | Kuroda et al. | 439/582 |
| 2008/0096420 | A1 * | 4/2008 | Zeng | 439/582 |
| 2008/0293299 | A1 * | 11/2008 | Liao et al. | 439/582 |
| 2010/0062641 | A1 * | 3/2010 | Maruyama | 439/582 |
| 2010/0068927 | A1 * | 3/2010 | Ho | 439/582 |
| 2012/0164880 | A1 * | 6/2012 | Chiu | 439/582 |
| 2012/0322304 | A1 * | 12/2012 | Taguchi | 439/582 |
| 2013/0149897 | A1 * | 6/2013 | Takano et al. | 439/582 |
| 2013/0196540 | A1 * | 8/2013 | Sasaki | 439/582 |

* cited by examiner

*Primary Examiner* — Gary Paumen
(74) *Attorney, Agent, or Firm* — CKC & Partners Co., Ltd.

(57) ABSTRACT

A connector connected with an end of a coaxial cable having a small diameter is provided. The connector includes an insulating housing, a signal terminal, and a shielding housing. The insulating housing has a hollow hole, a terminal cavity, and an insulating plate. The hollow hole of the insulating housing penetrates through two surfaces of the insulating housing, and communicates with the terminal cavity of the insulating housing. The signal terminal is assembled the terminal cavity. The signal terminal has a flat portion electrically connected to the internal conductive wires of the coaxial cable. The shielding housing has a circular portion and a cover. The circular portion surrounds the outer surface of the insulating housing, and the cover of the shielding housing presses the insulating plate of the insulating housing to enable the internal conductive wires of the coaxial cable to contact the signal terminal.

5 Claims, 6 Drawing Sheets

COAXIAL CABLE END CONNECTOR

RELATED APPLICATIONS

This application claims priority to Taiwan Application Serial Number 102201269, filed Jan. 18, 2013, which is herein incorporated by reference.

BACKGROUND

1. Field of Invention

The present invention relates to a coaxial cable end connector. More particularly to a coaxial cable end connector for being connected with an end of a coaxial cable having a small diameter.

2. Description of Related Art

Antennas disposed in high-frequency wireless electric devices are Generally installed outside printed circuit boards for lowering the influence of high frequency electric components disposed on printed circuit boards on high-frequency wireless signals emitted from the antenna. Therefore radio frequency properties of the antennas can be prevented from being unstable due to the operation of the electric components disposed on printed circuit boards. The communication of electrical signals between the antennas and printed circuit boards generally relies on the coaxial cable used as a signal transmission medium. In the limited space of the electric devices, an outer diameter of the coaxial cable and volume of the coaxial cable end connector compatible to printed circuit board are required to be as miniaturized as possible.

As shown in the figures, among the conventional coaxial cable connectors for being connected with an end of an axial cable having a small diameter, a design of a typical coaxial cable connector for being connected with an end of an axial cable having a small diameter is disclosed in U.S. Pat. No. 6,508,668. The conventional coaxial cable connector includes an insulating housing A1, a signal terminal A2, and a shielding housing A3. The insulating housing A1 has a first surface A11 and a second surface A12 opposite to the first surface A11. The first surface A11 of the insulating housing A1 faces a pair of connectors (not shown in the figure). The central region of the second surface A12 of the insulating housing A1 includes a hollow hole A121, a terminal cavity A122, and an insulating plate A123. The hollow hole A121 of the insulating housing A1 is formed penetrating the first surface A11 and the second surface A12. The terminal cavity A122 of the insulating housing A1 communicates with the hollow hole A121. The signal terminal A2 is disposed in the terminal cavity A122 of the second surface A12 of the insulating housing A1. The signal terminal A2 includes a flat portion A21, two opposite end walls A22, and a pair of contacting arms A23, in which the end walls A22 are formed respectively by bending the opposite ends of the signal terminal A2 in a direction toward a backside of the first surface A11, and the contacting arms A23 are respectively disposed on edges of the signal terminal A2 without the end walls in a direction toward the first surface A11 of the insulating housing A1. The two end walls A22 of the signal terminal A2 have a concave A221 for accommodating an internal conductive wire B1 of a coaxial cable B, so that an end of the internal conductive wire B1 of the coaxial cable B can be soldered with the flat portion A21 of the signal terminal A2. The contacting arms A23 of the signal terminal A2 are used for communicating electrical signals with a corresponding connector (not shown). The shielding housing A3 has an circular portion A31 and a cover A32, in which the cover A32 of the shielding housing A3 surrounds the outer surface of the insulating housing A1, and the cover A32 of shielding housing A3 presses the insulating plate A123 of the insulating housing A1 to be flattened between the cover A32 of the shielding housing A3 and the signal terminal A2. A set of front fasteners A321 and a set of back fasteners A322 are extended from the cover A32 of the shielding housing A3, in which the front fasteners A321 and the back fasteners A322 fasten a metallic shield 63 (metal wire mesh) and an external insulating layer B4 of the coaxial cable B respectively.

The general coaxial cable B suitable for the prior art skill is a four-layer structure, including the internal conductive wire B1, an internal insulating layer B2, the metallic shield B3, and the external insulating layer B4 arranged from a center to an external surface of the coaxial cable B sequentially. Since the end of the internal conductive wire B1 of the coaxial cable B is soldered with the flat portion A21 of the signal terminal A2 of the connector, and the metallic shield B3 and the external insulating layer B4 of the coaxial cable B are fastened respectively by the shielding housing A3 of the connector, the connector is combined with the end of the coaxial cable B firmly.

Since the coaxial cable end connector is soldered with the end of the coaxial cable B, and the coaxial cable end connector is suitable for the coaxial cable B of a single internal conductive wire, the internal conductive wire B1 of the coaxial cable B is one single inseparable conductive wire. For another coaxial cable B having internal conductive wires, the internal conductive wires are separable, so that it is difficult for a production line to neatly solder the respective internal conductive wires each having a small diameter with the fiat portion A21 of the signal terminal A2. The prior art skill is to solder the internal conductive wire B1 of the coaxial cable B with the flat portion A21 of the signal terminal A2. However, the scattered internal conductive wires each having a small diameter are difficult to be soldered, and the multi-core conductive wires of the respective coaxial cables of various coaxial cable end connectors generally have great differences for tin-wetting, resulting in the inconsistent electrical characteristics of the coaxial cable end connectors after soldering, and thus the conventional skills have to be improved.

SUMMARY

The invention provides a coaxial cable end connector connected with an end of the coaxial cable having a plurality of internal conductive wires, and the coaxial cable end connector can prevent the soldering process among the respective internal conductive wires.

The invention provides a connector connected with the end of the coaxial cable having a small diameter. The connector includes a insulating housing, a signal terminal, and a shielding housing. The coaxial cable having a small diameter is a cable with the multi-layer overlapped cladding structure, including an external insulating layer, a metallic shield, an internal insulating layer, and multiple internal conductive wires arranged from an outermost layer toward a center sequentially.

The insulating housing of the coaxial cable end connector has a first surface, a second surface, and a hollow hole, in which the first surface and the second surface of the insulating housing are opposite to each other but penetrated by the hollow hole, and the second surface of the insulating housing has a terminal cavity and an insulating plate. The terminal cavity of the insulating housing communicated with the hollow hole, so that the signal terminal can be disposed on the terminal cavity of the second surface of the insulating housing, and the insulating plate is disposed on the edge of the terminal cavity of the insulating housing. The signal terminal has a flat portion and two contacting arms extended from the flat portion toward the first surface of the insulating housing, so that the contacting arms of the signal terminal can be extended from the terminal cavity of the second surface of the insulating housing toward the first surface of the insulating housing. The flat portion of the signal terminal has a pair of end walls extending away from the fiat portion of the signal terminal by some distance, and a concave is formed on the end walls of the signal terminal. The end of the internal conductive wires of the coaxial cable is disposed inside the concave of the signal terminal, and the size of the concave on the end walls is equal to or smaller then the sum outer diameter size of the respective internal conductive wires of the coaxial cable.

The shielding housing of the connector has a circular portion and a cover. The circular portion of the shielding housing surrounds the outer surface of the insulating housing, and the cover of the shielding housing presses the insulating plate of the insulating housing, so that the respective internal conductive wires of the coaxial cable are forced to contact the concave of the end walls of the signal terminal.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
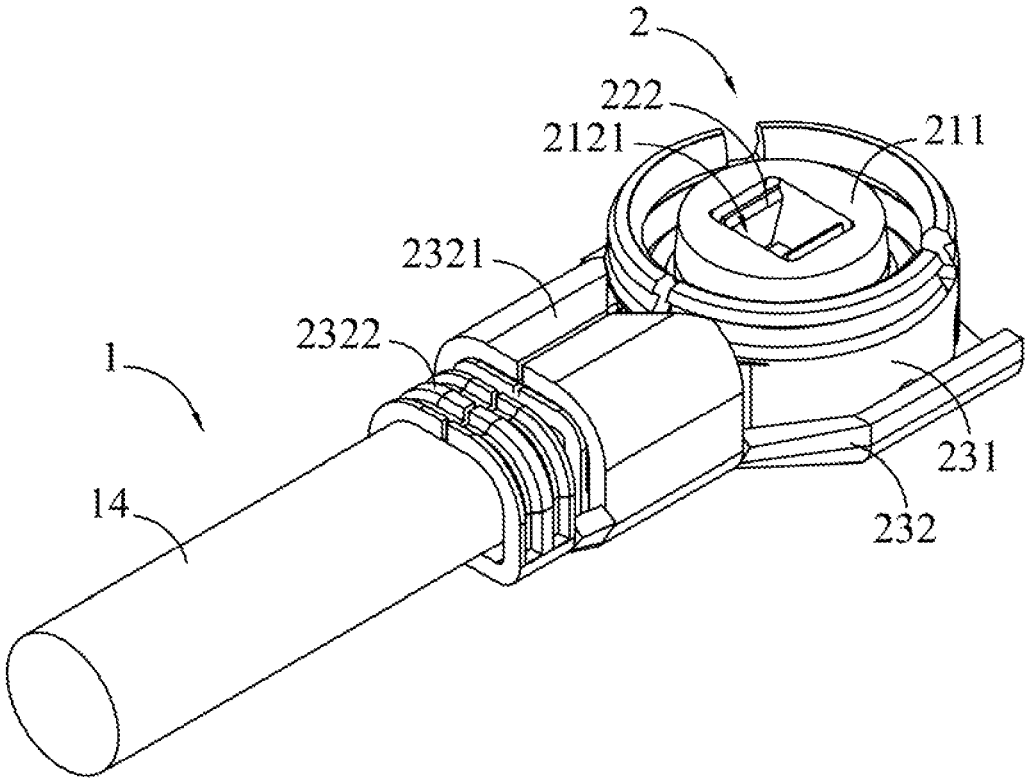
FIG. 1 is a 3D view of a coaxial cable end connector assembled with a coaxial cable according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
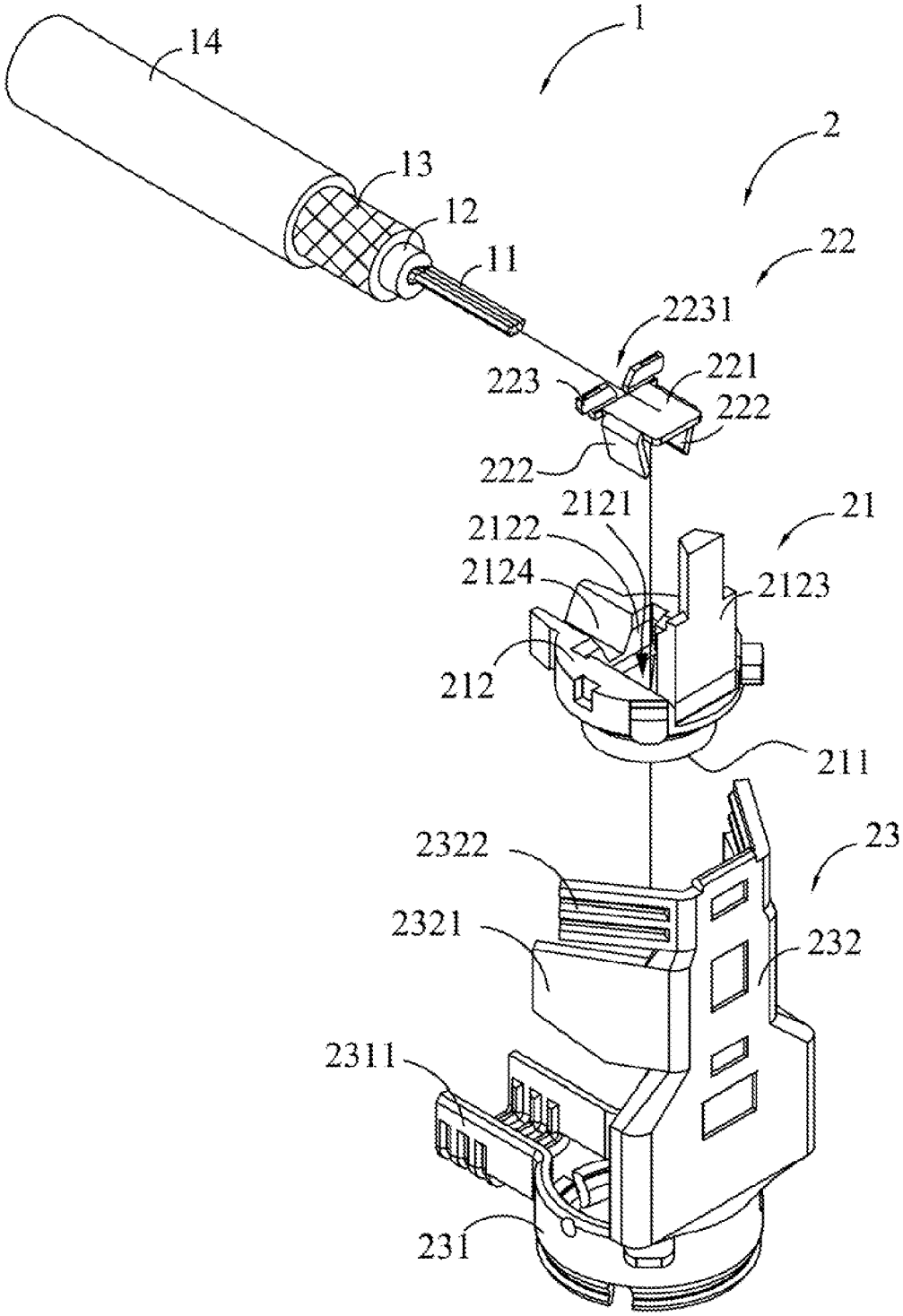
FIG. 2 is an exploded view shown in FIG. 1.
Figure 3:
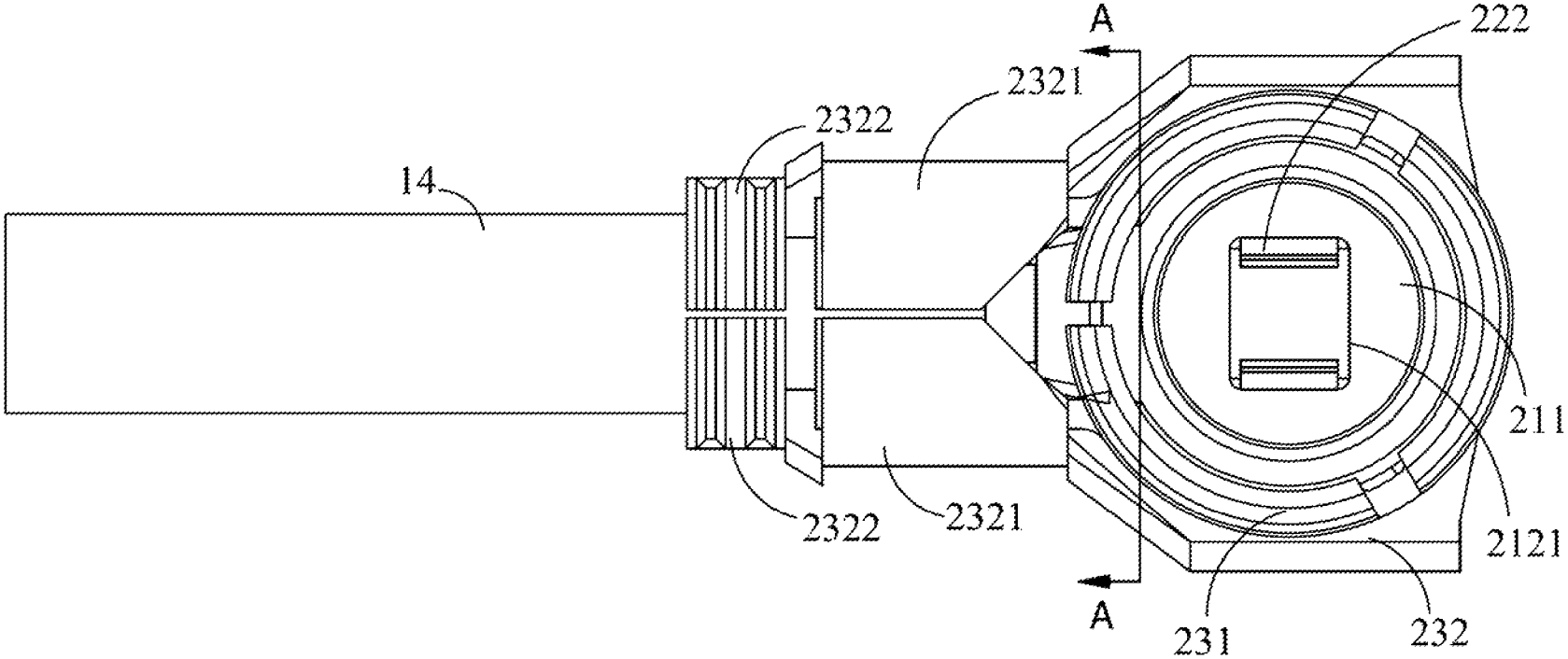
FIG. 3 is a top view of FIG. 1.
Figure 4:
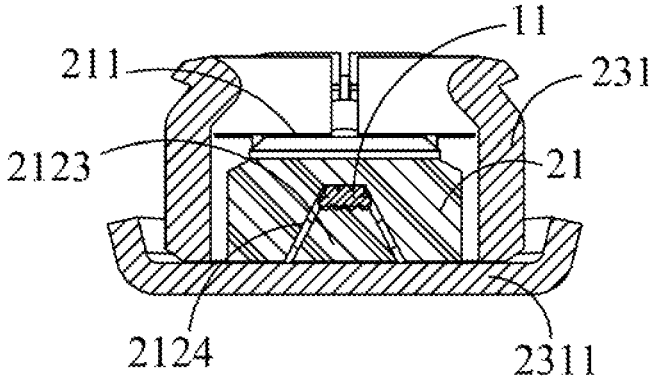
FIG. 4 is a cross-sectional view viewed along line A-A in FIG. 3.

As shown in FIG. 2, the invention provides a coaxial cable end connector 2 suitable for being connected with an end of a coaxial cable 1. The coaxial cable 1 is a four-layer structure including internal conductive wires 11, an internal insulating layer 12, a metallic shield 13, and an external insulating layer 14. The internal conductive wires 11 of the coaxial cable 1 have a new-typed multiple-wires structure (e.g. seven wires). For considering the electrical characteristic of the coaxial cable 1, the appearance of the internal conductive wires 11 of the coaxial cable 1 are different from that of a conventional single wire structure; however, the overall structure and function of the coaxial cable 1 are still the same as the conventional structure.

The coaxial cable end connector 2 includes an insulating housing 21, a signal terminal 22, and a shielding housing 23. The insulating housing 21 is made from a material with poor conductance for insulating electrical signals transmitted by the signal terminal 22 from the shielding housing 23, thereby preventing the signal terminal 22 from communicating with the shielding housing 23 accidentally. The insulating housing 21 is a substantially cylindrical structure. The insulating housing 21 has a pair of plane surfaces that are opposite to each other, i.e. a first surface 211 and a second surface 212. A hollow hole 2121 is formed between the first surface 211 and the second surface 212 of the insulating housing 21. The hollow hole 2121 of the insulating housing 21 penetrates the first surface 211 and the second surface 212 of the insulating housing 21, so that the hollow hole 2121 of the insulating housing 21 may communicate with the first surface 211 and the second surface 212. A terminal cavity 2122 is formed on the second surface 212 of the insulating housing 21. The terminal cavity 2122 is communicated with the hollow hole 2121, so that the signal terminal 22 of the connector 2 can be disposed in the terminal cavity 2122 of the insulating housing 21.

A cable cavity 2124 and an insulating plate 2123 are respectively disposed on the edges of the terminal cavity 2122 of the second surface 212 of the shielding housing 21 which are not adjacent to each other, in which the cable cavity 2124 of the shielding housing 21 can at least contain the respective internal conductive wires 11 of the coaxial cable 1. The insulating plate 2123 of the insulating housing 21 is a flexible suspension arm structure, which can be bent to deform toward the terminal cavity 2122. When the signal terminal 22 is assembled inside the terminal cavity 2122 of the insulating housing 21, and the respective internal conductive wires 11 of the coaxial cable 1 extend from the terminal cavity 2122 of the insulating housing 21 toward the insulating plate 2123, the flexibly deformable insulating plate 2123 of the insulating housing 21 can press and force the respective internal conductive wire 11 of the coaxial cable 1 to contact the signal terminal 22.

Figure 5:
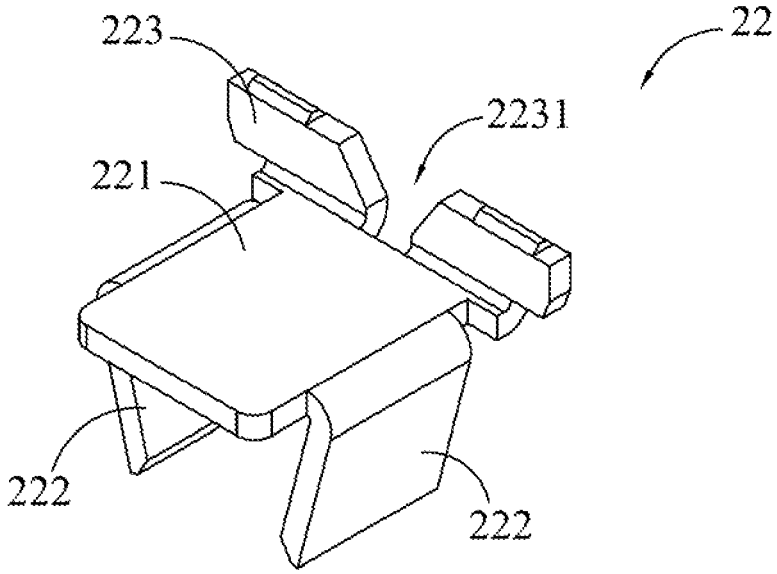
FIG. 5 is an enlarged view of a signal terminal of an coaxial cable end connector according to an embodiment of the present invention.
Figure 6:
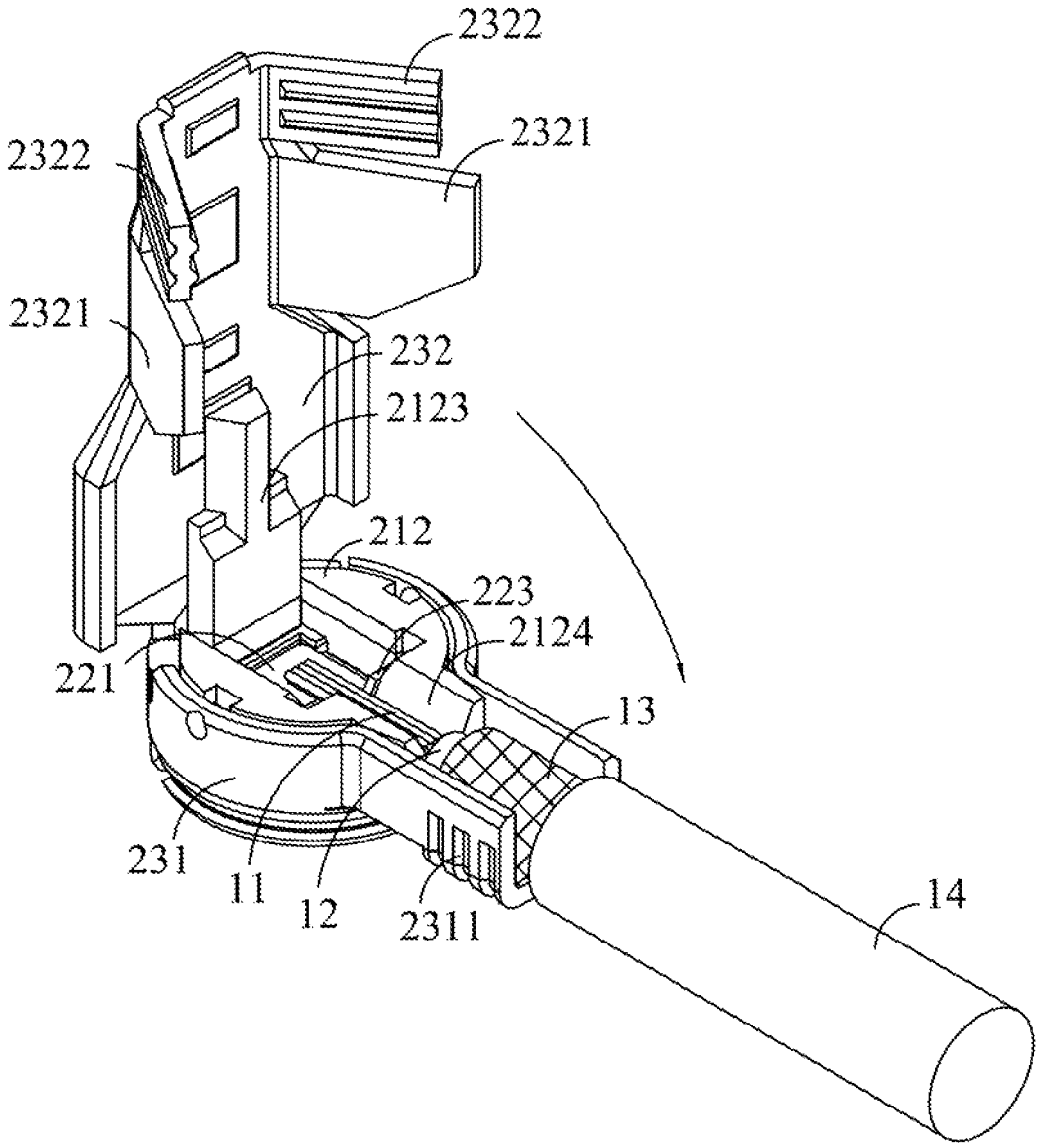
FIG. 6 is a schematic view showing a semi-assembled coaxial cable end connector according to an embodiment of the present invention.
Figure 7:
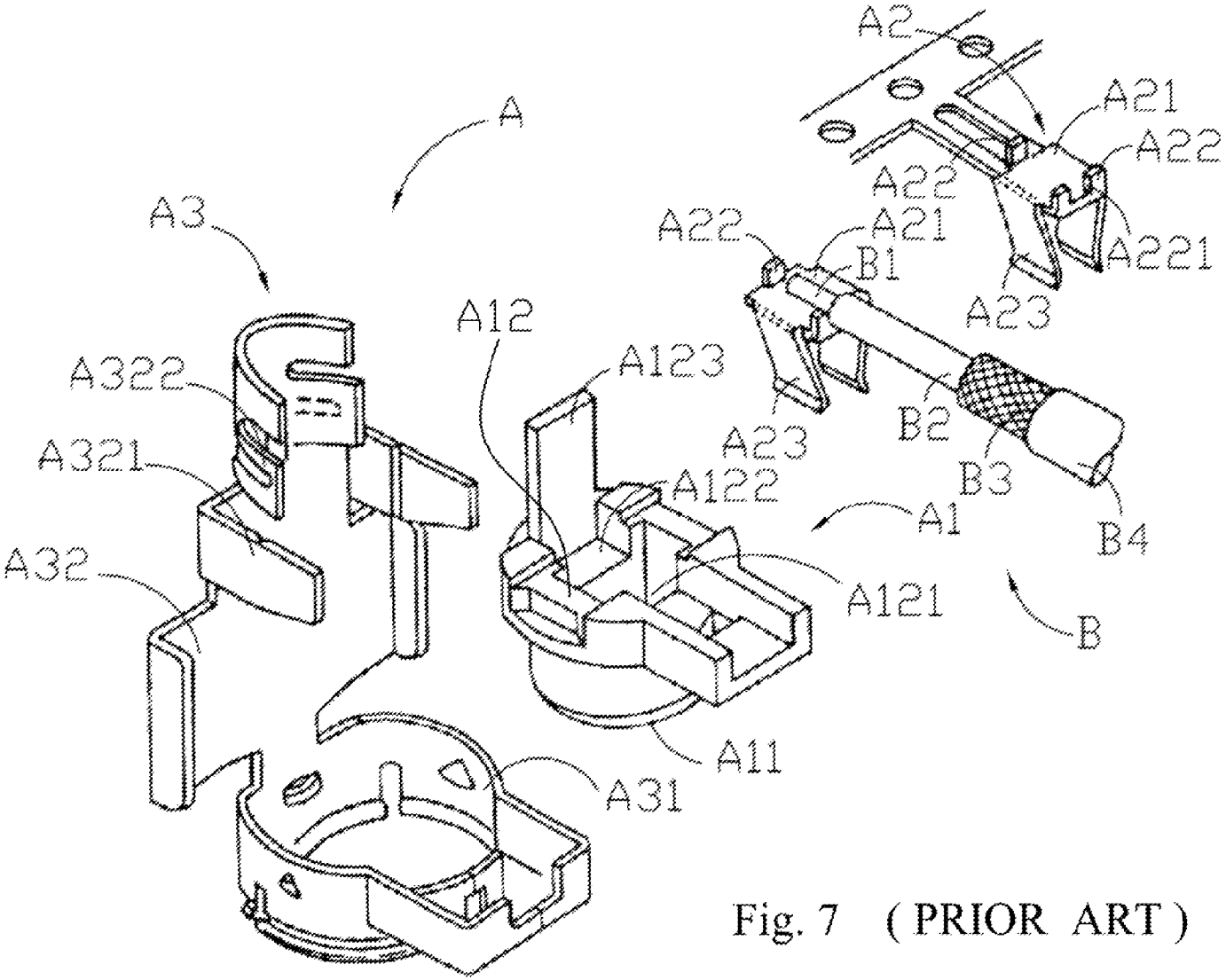
Fig. 7 (PRIOR ART)
FIG. 7 is an exploded view of a conventional coaxial cable end connector with a coaxial cable.

As shown in the FIG. 2 to the FIG. 5, the signal terminal 22 of the connector 2 is made by stamping a metal flat board The signal terminal 22 is utilized for transmitting the high-frequency electrical signals of the coaxial cable 1 The signal terminal 22 has a flat portion 221 and two contacting arms 222 formed by bending the opposite edges of the flat portion 221 of the signal terminal 22 respectively. After the signal terminal 22 is assembled inside the terminal cavity 2122 of the insulating housing 21, the contacting arms 222 of the signal terminal 22 are inserted into the hollow hole 2121 of the insulating housing 21, that is, the two contacting arms 222 of the signal terminal 22 are extended from the terminal cavity 2122 (on the second surface) of the insulating housing 21 toward the first surface 211 of the insulating housing 21.

A pair of end walls 223 is extended between the contacting arms 222 in the flat portion 221 of the signal terminal 22 toward the opposite direction of the contacting arms 222 of the signal terminal 22. The central region of the two end walls 223 has a concave 2231, and the size of the concave 2231 of the signal terminal 22 is gradually narrowed from the edge of the end wails 223 toward the flat portion 221 of the signal terminal 22, in which the most narrow area of the concave 2231 of the signal terminal 22 is smaller than a sum of outer diameters of the respective internal conductive wires 11 of the coaxial cable 1. When the signal terminal 22 is assembled in the terminal cavity 2122 of the insulating housing 21, the shape of the end wails 223 of the signal terminal 22 is designed for coupling to the terminal cavity 2122 of the insulating housing 21, whereby the signal terminal 22 are retained within the terminal cavity 2122 of the insulating housing 21.

When the respective internal conductive wires 11 of the coaxial cable 1 are pressed by the insulating plate 2123 of the insulating housing 21 and close to the flat portion 221 of the signal terminal 22, the end walls 223 of the signal terminal 22 guide the respective internal conductive wires 11 of the coaxial cable 1 to enter the concave 2231 of the signal terminal 22. In order to ensure that the insulating plate 2123 of the insulating housing 21 presses the respective internal conductive wires 11 of the coaxial cable 1 to enter the concave 2231 of the signal terminal 22, the shape and size of the insulating plate 2123 of the insulating housing 21 is complementary to the shape and size of the concave 2231 of the signal terminal 22, so that the insulating plate 2123 of the insulating housing 21 can completely enter the concave 2231 of the signal terminal 22.

Since the concave 2231 of the signal terminal 22 is gradually narrowed toward the flat portion 223 of the signal terminal 22, when the respective internal conductive wires 11 of the coaxial cable 1 is pressed by the insulating plate 2123 of the insulating housing 21 and close to the flat portion 223 of the signal terminal 22, the respective internal conductive wires 11 of the coaxial cable 1 are forced to contact the edge of concave 2231 of the signal terminal 22, so that the respective internal conductive wires 11 of the coaxial cable 1 and the signal terminal 22 are electrically conducted. In the embodiments disclosed by the present invention, the shape of the concave 2231 of the signal terminal 22 is a conical notch, so that the shape of the insulating plate 2123 of the insulating housing 21 may be a cone complementary to the concave 2231 of the signal terminal 22, that is, the insulating plate 2123 of the insulating housing 21 has a trapezoidal cross-section.

As shown in the figures of the present invention, the shielding housing 23 is made by stamping a metal flat board as the signal terminal 22. The insulating housing 21 is formed between the signal terminal 22 and the shielding housing 23 for preventing the shielding housing 23 from accidentally contacting the signal terminal 22. The shielding housing 23 has a circular portion surrounding the outer surface of the insulating housing, a cover, a set of front fasteners 2321 and a set of back fasteners 2322. A shielding cover 2311 is extended from the circular portion 231 of the shielding housing, and the shielding cover 2311 cover the cable cavity 2124 from the first surface 211 of the insulating housing 21, thereby preventing the high-frequency electrical signals transferred by the respective internal conductive wires 11 of the coaxial cable 1 from being interfered by the external electromagnetic waves.

The cover 232 of the shielding housing 23 is extended to the circular portion 231, and the cover 232 can at least cover the second surface 212 of the insulating housing 21, whereby the second surface 212 of the shielding housing 21 is isolated from the electromagnetic waves interfering with the external environment. Meanwhile, the cover 232 of the shielding housing 23 can press the insulating plate 2123 of the insulating housing 21 to keep the insulator 2123 of the insulating housing 21 at a predetermined position, thereby preventing the respective internal conductive wires 11 of the coaxial cable 1 or the signal terminal 22 from escaping from the insulating housing 21.

The shielding housing 23 has a set of front fasteners 2321 and a set of back fasteners 2321 extended from the cover 232, in which the front fasteners 2321 of the shielding housing 23 are extended from the second surface 212 of the insulating housing 21 toward the shielding cover 2311 of the shielding housing 23. Therefore, the front fasteners 2321 of the shielding housing 23 can hold at least one portion of the shielding cover 2311 and the metallic shield 13 of the coaxial cable 1, thereby encapsulating the insulating housing 21, the signal terminal 22, and the exposed internal conductive wire 11 of the coaxial cable 1 between the circular potion 231 of the shielding housing 23 and the cover 232. The back fasteners 2322 of the shielding housing 23 are extended from the cover 232 of shielding housing 23, and the back fasteners 2322 of the shielding housing 23 can directly fasten the outer insulating housing 14 of the coaxial cable 1.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A coaxial cable end connector for mounting a connector on a coaxial cable end having a plurality of internal conductive wires, the coaxial cable end connector comprising:

an insulating housing comprising a first surface and a second surface opposite to the first surface, wherein the first surface of the insulating housing has a hollow hole facing toward the second surface, and the second surface of the insulating housing has a terminal cavity and an insulating plate, wherein the terminal cavity of the insulating housing is communicated with the hollow hole;

a signal terminal disposed in the terminal cavity of the second surface of the insulating housing, the signal terminal having a flat portion and two contacting arms extended from the flat portion toward the first surface of the insulating housing, wherein the flat portion is electrically connected to ends of the internal conductive wires of the coaxial cable; and a shielding housing, comprising:

a circular portion surrounding an outer surface of the shielding housing; and a cover pressing the insulating plate of the insulating housing for enabling the internal conductive wires of the coaxial cable to contact the signal terminal, wherein the flat portion of the signal terminal has a pair of end walls with a concave, the concave having an upper width smaller than a sum of outer diameters of the internal conductive wires of the coaxial cable, and a shape and size of at least a portion of the insulating plate of the insulating housing is similar to a shape and size of the concave of the signal terminal so as to be received in the concave.

2. The coaxial cable end connector of claim 1, wherein the concave having a lower width, and the upper width is greater than the lower width.

3. The coaxial cable end connector of claim 2, wherein the insulating plate of the insulating housing has a trapezoidal cross-section.

4. The coaxial cable end connector of claim 1, wherein the end walls of the signal terminal interfere with the terminal cavity of the insulating housing.

5. The coaxial cable end connector of claim 1, wherein the insulating plate of the insulating housing is operated to press the internal conductive wires of the coaxial cable into the concave of the signal terminal, thereby forcing the internal conductive wires of the coaxial cable to contact the concave of the signal terminal.

* * * * *